US009466916B2

(12) United States Patent
Li et al.

(10) Patent No.: US 9,466,916 B2
(45) Date of Patent: Oct. 11, 2016

(54) MULTI-CONTACT CONNECTOR ASSEMBLY

(71) Applicant: Schlumberger Technology Corporation, Sugar Land, TX (US)

(72) Inventors: Haoming Li, Sugar Land, TX (US); Pratik Halani, Sugar Land, TX (US); Srinand Sreedharan Karuppoor, Sugar Land, TX (US); Luis Pamintuan, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/717,412

(22) Filed: May 20, 2015

(65) Prior Publication Data

US 2015/0340803 A1 Nov. 26, 2015

Related U.S. Application Data

(60) Provisional application No. 62/001,449, filed on May 21, 2014.

(51) Int. Cl.

| | |
|---|---|
| ***H01R 13/523*** | (2006.01) |
| ***H01R 13/52*** | (2006.01) |
| ***H01R 13/453*** | (2006.01) |

(Continued)

(52) U.S. Cl.

CPC ..... *H01R 13/5219* (2013.01); *E21B 17/023* (2013.01); *E21B 17/028* (2013.01); *H01R 13/4538* (2013.01); *H01R 43/26* (2013.01); *H01R 13/523* (2013.01); *H01R 13/533* (2013.01); *H01R 24/58* (2013.01); *Y10T 29/4921* (2015.01)

(58) Field of Classification Search

CPC ..... H01R 13/523; E21B 17/028

See application file for complete search history.

(56) References Cited

U.S. PATENT DOCUMENTS 3,989,330 A * 11/1976 Cullen ..... E21B 17/028 439/194

4,117,287 A * 9/1978 Walker ..... H01R 13/523 200/302.1

(Continued)

FOREIGN PATENT DOCUMENTS

WO 2009042494 A2 4/2009

OTHER PUBLICATIONS

International Search Report and Written Opinion issued in related PCT application PCT/US2015/031912 on Aug. 18, 2015, 3 pages.

*Primary Examiner* — Gary Paumen

(74) *Attorney, Agent, or Firm* — John Vereb

(57) ABSTRACT

A multi-contact electrical connector assembly includes a first connector housing to electrically couple to a second connector housing. A moveable piston is disposed in a bore of the first housing and is biased to be adjacent a first plurality of electrical contacts on a surface of the bore. An end of the first housing has a first pressure connector electrically coupled to the first plurality of electrical contacts. A moveable annular piston is disposed about a rod in a bore of the second connector housing and is biased to isolate a second plurality of electrical contacts on an outer surface of the rod. The second housing also has a pressure connector electrically coupled to the second plurality of electrical contacts. The moveable piston and the moveable annular piston are simultaneously moveable to expose and matingly engage the electrical contacts.

20 Claims, 10 Drawing Sheets

(51) Int. Cl.

| | |
|---|---|
| ***H01R 43/26*** | (2006.01) |
| ***E21B 17/02*** | (2006.01) |
| *H01R 13/533* | (2006.01) |
| *H01R 24/58* | (2011.01) |

(56) References Cited

U.S. PATENT DOCUMENTS

| | | | | | |
|---|---|---|---|---|---|
| 4,500,156 | A | | 2/1985 | Nguyen | |
| 4,589,717 | A | * | 5/1986 | Pottier | H01R 13/523 439/140 |
| 4,660,910 | A | * | 4/1987 | Sharp | E21B 17/028 439/194 |
| 4,767,349 | A | * | 8/1988 | Pottier | H01R 13/523 166/65.1 |
| 5,052,941 | A | * | 10/1991 | Hernandez-Marti | E21B 33/0385 166/65.1 |
| 5,221,214 | A | * | 6/1993 | Martin | H01R 13/523 439/191 |
| 5,389,003 | A | * | 2/1995 | Van Steenwyk | E21B 17/028 439/190 |
| 5,927,402 | A | * | 7/1999 | Benson | E21B 21/103 166/324 |
| 5,947,198 | A | | 9/1999 | McKee et al. | |
| 6,298,921 | B1 | * | 10/2001 | Kobylinski | E21B 17/028 166/380 |
| 6,511,335 | B1 | | 1/2003 | Rayssiguier et al. | |
| 7,059,881 | B2 | * | 6/2006 | Song | E21B 4/18 439/191 |
| 7,074,064 | B2 | | 7/2006 | Wallace | |
| 7,201,240 | B2 | * | 4/2007 | Hall | E21B 17/028 166/65.1 |
| 7,390,032 | B2 | * | 6/2008 | Hughes | E21B 17/028 285/330 |
| 7,404,725 | B2 | * | 7/2008 | Hall | E21B 17/028 439/194 |
| 7,413,021 | B2 | * | 8/2008 | Madhavan | B21D 39/04 166/380 |
| 2005/0016769 | A1 | | 1/2005 | Wallace | |
| 2013/0008669 | A1 | * | 1/2013 | Deere | E21B 33/0385 166/378 |

* cited by examiner

MULTI-CONTACT CONNECTOR ASSEMBLY

CROSS-REFERENCE TO RELATED APPLICATIONS

This application claims the benefit of U.S. Provisional Patent Application Ser. No. 62/001,449 filed 21 May 2014, and entitled "Multi-Contact Connector Assembly," the disclosure of which is hereby incorporated herein by reference in its entirety.

STATEMENT REGARDING FEDERALLY SPONSORED RESEARCH OR DEVELOPMENT

Not applicable.

BACKGROUND

In drilling a wellbore into the earth, such as for the recovery of hydrocarbons or minerals from a subsurface formation, it is conventional practice to connect a drill bit onto the lower end of a "drillstring," then rotate the drillstring so that the drill bit progresses downward into the earth to create the desired borehole. A typical drillstring is made up from an assembly of drill pipe sections connected end-to-end, plus a bottom hole assembly (BHA) disposed between the bottom of the drill pipe sections and the drill bit. The BHA is typically made up of sub-components such as drill collars, stabilizers, reamers, logging-while-drilling (LWD) tools, measurement-while-drilling (MWD) tools, and/or other drilling tools and accessories, selected to suit the particular requirements of the well being drilled.

MWD tools may provide drilling parameter information such as weight-on-bit, torque, temperature, pressure, direction, and inclination; and LWD tools may provide formation evaluation measurements such as resistivity, porosity, NMR distributions, and the like. The tools and/or components making up the BHA may be connected using one or more electrical connectors, which enable communications and transmission of electrical signals between the tools in the BHA.

SUMMARY

Embodiments of a multi-contact electrical connector assembly include a first connector housing to electrically couple to a second connector housing. A moveable piston disposed in a bore of the first connector housing is biased to be adjacent a first plurality of electrical contacts on a surface of the bore. An end of the first connector housing has a first pressure connector electrically coupled to the first plurality of electrical contacts, wherein the first pressure connector can electrically couple to a first tubular member. The assembly may further include a moveable annular piston disposed about a rod in a bore of the second connector housing, wherein the moveable annular piston is biased to isolate a second plurality of electrical contacts on an outer surface of the rod. An end of the second connector housing has a second pressure connector electrically coupled to the second plurality of electrical contacts, wherein the second pressure connector can electrically couple to a second tubular member. In some embodiments, the moveable piston and the annular piston are simultaneously moveable to expose and matingly engage the first plurality of electrical contacts with the second plurality of electrical contacts. In some embodiments, the first connector housing is moveable into the second connector housing and against the annular piston to overcome the annular piston biasing and expose the second plurality of contacts, and the rod is moveable into the first connector housing and against the moveable piston to overcome the moveable piston biasing and move the second plurality of electrical contacts adjacent the first plurality of electrical contacts. In certain embodiments, the first and second pressure connectors are connectable and removeable to selectively electrically pressure-connect the electrical connector assembly between the first and second tubular members.

Embodiments of a multi-contact electrical connector assembly include a first connector housing having a bore therein. The first connector housing also includes a moveable piston disposed in the bore of the first connector housing, wherein the moveable piston includes an annular seal disposed on an outer surface of the moveable piston. A first plurality of electrical contacts is disposed on a surface of the bore of the first connector housing. A biasing member is disposed in the bore of the first connector housing between a terminal end of the bore in the first connector housing and the moveable piston. A first pressure connector on the first connector housing is to releasably provide both a pressure barrier between the bore of the first connector housing and a bore of a first tubular member and an electrical connection between the first plurality of electrical contacts and the first tubular member. In some embodiments, sealing engagement between the annular seal of the moveable piston and the first connector housing bore forms a sealed chamber between the annular seal and the terminal end of the first connector housing bore. The assembly may also include a second connector housing having a bore therein, a rod in the bore of the second connector housing, a second plurality of electrical contacts to mate with the first plurality of electrical contacts, and a second pressure connector on the second connector housing to releasably provide both a pressure barrier between the bore of the second connector housing and a bore of a second tubular member and an electrical connection between the second plurality of electrical contacts and the second tubular member.

Embodiments of a method of forming an electrical connection include removably coupling a first connector housing to a terminal end of an extender disposed in a first drill collar to provide both a pressure barrier and an electrical connection between the first connector housing and the first drill collar, removably coupling a second connector housing to a terminal end of an extender disposed in a second drill collar to provide both a pressure barrier and an electrical connection between the second connector housing and the second drill collar, inserting a rod of the second connector housing having a plurality of annular electrical contacts disposed thereon into a bore of the first connector housing, and matingly connecting the annular electrical contacts of the second connector housing with a plurality of annular electrical contacts disposed on a surface of the bore of the first connector housing.

The foregoing has outlined rather broadly a selection of features of the disclosure such that the detailed description of the disclosure that follows may be better understood. This summary is not intended to identify key or essential features of the claimed subject matter, nor is it intended to be used as an aid in limiting the scope of the claimed subject matter.

BRIEF DESCRIPTION OF THE DRAWINGS

Embodiments of the disclosure are described with reference to the following figures.

DETAILED DESCRIPTION

Figure 1:
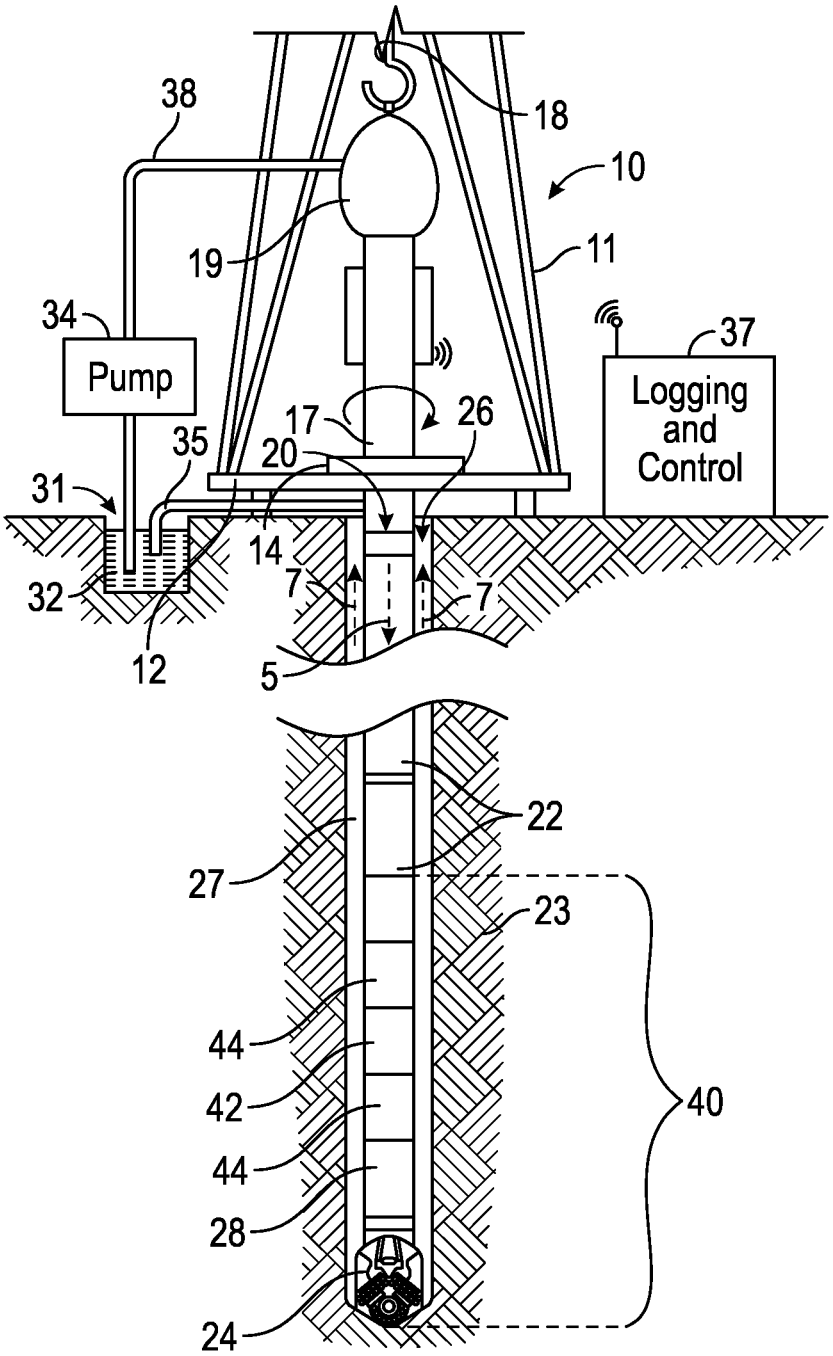
FIG. 1 illustrates a well system in which embodiments of an electrical connector assembly can be implemented.

One or more embodiments of the present disclosure are described below. These embodiments are merely examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features. The drawing figures are not necessarily to scale. Certain features and components disclosed herein may be shown exaggerated in scale or in somewhat schematic form, and some details of conventional elements may not be shown in the interest of clarity and conciseness.

The terms "including" and "comprising" are used herein, including in the claims, in an open-ended fashion, and thus should be interpreted to mean "including, but not limited to . . . . " Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. If the connection transfers electrical power or signals, the coupling may be through wires or other modes of transmission. In some of the figures, one or more components or aspects of a component may be not displayed or may not have reference numerals identifying the features or components that are identified elsewhere in order to improve clarity and conciseness of the figure.

Referring now to FIG. 1, an embodiment of a well system 10 is shown. Well system 10 includes a derrick 11 having a floor 12 supporting a rotary table 14 and a drillstring 20 for drilling a borehole 26. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

In this embodiment, drillstring 20 is made of a plurality of pipe joints 22 connected end-to-end, and extends downward from the rotary table 14 into the borehole 26. A drill bit 24 is coupled to a downhole end of drillstring 20 and is rotated with weight-on-bit (WOB) applied to drill the borehole 26 through an earthen formation 23. A kelly 17 is coupled to an upper end of the drillstring 20, and is engaged by rotation of the rotary table 14. Drillstring 20 is suspended from derrick 11 via a hook 18 and a rotary swivel 19, which permits rotation of drillstring 20 relative to hook 18. In this embodiment, drill bit 24 can be rotated from the surface by drillstring 20 via rotary table 14 and/or a top drive, rotated by a downhole mud motor 28 disposed along drillstring 20 proximal bit 24, or combinations thereof (e.g., rotated by both rotary table 14 via drillstring 20 and mud motor 28, rotated by a top drive and mud motor 28, etc.). For example, rotation via downhole motor 28 may be employed to supplement the rotational power of rotary table 14, if required, and/or to affect changes in the drilling process.

During drilling operations a suitable drilling fluid 31 is pumped under pressure from a mud pit 32 through the drillstring 20 by a mud pump 34. Drilling fluid 31 passes from the mud pump 34 into the drillstring 20 via a fluid line 38. The drilling fluid 31 flows through drillstring 20 as indicated by arrow 5, is discharged at the borehole bottom through nozzles in drill bit 24, circulates to the surface through an annular space 27 radially positioned between drillstring 20 and the sidewall of borehole 26 as indicated by arrow 7, and then returns to mud pit 32 via a return line 35.

Drillstring 20 further includes a bottomhole assembly (BHA) 40 proximal drill bit 24. In general, BHA 40 may include drill collars, drilling stabilizers, a mud motor, directional drilling equipment, a rotary steerable system (RSS), a power generation turbine, as well as capabilities for measuring, processing, and storing information, and communicating with the surface (e.g., MWD/LWD tools, telemetry hardware, etc.). In this embodiment, BHA 40 generally includes drill bit 24, mud motor 28, a MWD module or tool 42, and a plurality of LWD modules or tools 44. As used herein, the term "module" as applied to MWD and LWD devices is understood to mean either a single tool or a suite of multiple tools. The LWD modules 44 may be housed in a tubular drill collar and can include one or more types of logging tools. For instance, LWD modules 44 may include capabilities for measuring, processing, and storing information, as well as for communicating with the surface equipment. By way of example, LWD modules 44 may include a nuclear magnetic resonance (NMR) logging tool, a resistivity tool, an acoustic/sonic tool, a nuclear tool, a dielectric tool, a formation sampling tool, and so forth, and may include capabilities for measuring, processing, and storing information, and for communicating with surface equipment. MWD module 42 is also housed in a drill collar, and may include one or more devices for measuring characteristics of drillstring 20 and drill bit 24. By way of example, MWD module 44 may include a WOB measuring device, a torque measuring device, a vibration measuring device, a shock measuring device, a stick/slip measuring device, a direction measuring device, an inclination measuring device, and/or a telemetry device.

In this embodiment, the operation of well system 10 may be controlled using control system 37 located at the surface. The control system 37 may include one or more processor-based computing systems. In the present context, a processor may include a microprocessor, programmable logic devices (PLDs), field-gate programmable arrays (FPGAs), application-specific integrated circuits (ASICs), system-on-a-chip processors (SoCs), or any other suitable integrated circuit capable of executing encoded instructions stored, for example, on tangible computer-readable media (e.g., read-only memory, random access memory, a hard drive, optical disk, flash memory, etc.). Such instructions may correspond to, for instance, workflows and the like for carrying out a drilling operation, algorithms and routines for processing data received at the surface from the BHA 40 (e.g., as part of an inversion to obtain one or more desired formation parameters), and so forth.

In order to pass or transmit electrical signals and/or power between different modules or tools of BHA 40 (e.g., MWD module 42 and LWD modules 44), a plurality of conductors (as will be discussed further herein) extend through tubular conduits or extenders that are disposed within the drilling collars housing the downhole tools, such as the MWD and LWD modules 42 and 44, respectively. For instance, a MWD tool of a BHA may include an electronics module (e.g., a sensor package) mounted on a chassis that is supported by the drill collar in which the MWD tool is housed. A first extender may couple to the electronics module of the MWD tool at a "shop joint" via a first electrical connector, thereby providing an electrical connection between the electronics module and the conductors disposed in the first extender. The first extender may extend between the electronics module of the MWD tool and a terminal end of the drill collar housing the particular electronics module. At the terminal end of the drill collar the first extender may couple to a second extender disposed in an axially adjacent downhole tool (e.g., a LWD tool) of the BHA at a "field joint" via a second electrical connector.

In this arrangement, the first extender may be a "female" extender while the second extender may be a "male" extender. The shop joint connecting the electronics module and the first extender may be made up during assembly of the MWD/LWD tool at a separate location from the well system, and the electrical connector forming the shop joint may be a "dry stab" or "dry mate" connector. The field joint connecting the first or female extender to the second or male extender may be made up or assembled during assembly of the BHA on the rig platform of a well system during a drilling operation. As such, the electrical connector forming the field joint may be a "wet stab" or "wet mate" connector that is exposed to the rig environment of well system 10. Specifically, the wet stab connector may be exposed to ambient air, moisture, dust, drilling mud, and other materials during make up or coupling of the axially adjacent downhole tools of the BHA.

Figure 2:
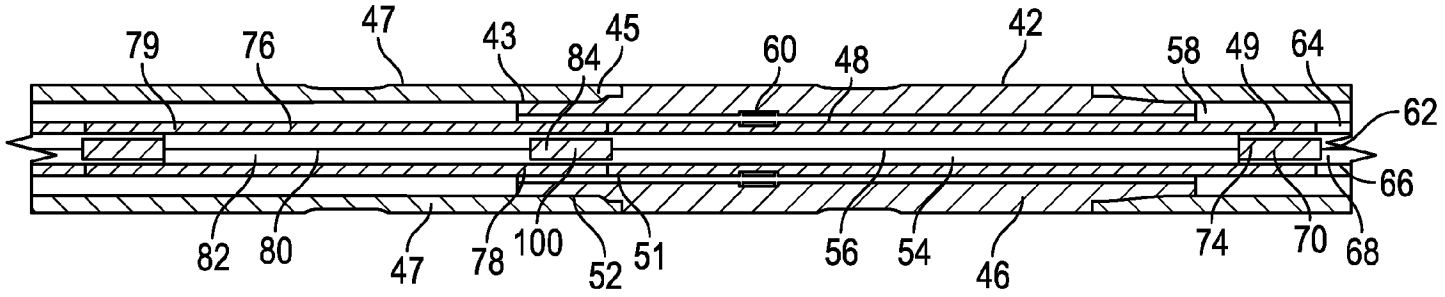
FIG. 2 illustrates a drill collar segment in which embodiments of an electrical connector assembly can be implemented.

Referring to FIG. 2, an embodiment of a segment of the BHA 40 of FIG. 1 is shown. In this embodiment, MWD module 42 has a terminal end 43 and generally includes a tubular member or housing 46 and a generally tubular female extender 48 disposed in the housing 46. Housing 46 may be a drill collar or other tubular member and includes a "pin" or "pin end" 50 at terminal end 44 having external threads 52 and configured to rotationally couple with a "box" or "box end" 45 of an axially adjacent tubular member or drill collar 47 to form a threaded connection therebetween. Female extender 48 has a first terminal end 49, a second terminal end 51, and a generally cylindrical passage 54 extending between terminal ends 49 and 51. Disposed within passage 54 is a plurality of individually insulated electrical conductors 56 extending between terminal ends 49 and 51 of female extender 48.

An annulus 58 is formed between a generally cylindrical outer surface of female extender 48 and a generally cylindrical inner surface of housing 46. In this embodiment, annulus 58 may form a flowpath for drilling fluid 31 flowing through BHA 40 in the direction indicated by arrow 5 (FIG. 1). Disposed within annulus 58 is a centralizer 60, which physically engages the outer surface of extender 48 and the inner surface of housing 46, thereby radially positioning extender 48 within housing 46. MWD module 42 also includes an electronics module 62 (partially shown in FIG.

2) having a terminal end 64 disposed axially adjacent first terminal end 49 of female extender 48 and including a plurality of conductors 66 disposed in a passage 68.

Disposed between the terminal end 64 of electronics module 62 and first terminal end 49 of female extender 48 is a shop joint 70 that forms a mechanical connection between electronics module 62 and female extender 48 and an electrical connection between conductors 66 and 56, respectively. In this embodiment, shop joint 70 may be made up or assembled at a site remote from well system 10, thereby preventing the exposure of shop joint 70 to the rig environment at rig floor 12. First terminal end 49 of female extender 48 includes a pin end received within a box end at terminal end 64 of electronics module 62, thereby forming a mechanical coupling between electronics module 62 and female extender 48. An annular seal (not shown) may be disposed radially between the pin end of the terminal end 49 of female extender 48 and the pin end of terminal end 64 of electronics module 62 to seal cylindrical passage 54 from the surrounding annulus 58. In this embodiment, a "dry stab" or "dry mate" electrical connector 74 is disposed within shop joint 70 to electrically couple conductors 66 of electronics module 62 with conductors 56 of female extender 48. In particular, dry stab electrical connector 74 may include a high pressure connection, such as a pressure bulkhead connector, to prevent fluid communication between passage 68 of electronics module 62 and passage 54 of female extender 48 via shop joint 70.

MWD module 42 further includes a generally cylindrical male extender 76 disposed within tubular member 47 and having a first terminal end 78, second terminal end 79, and a plurality of conductors 80 disposed in an internal passage 82. First terminal end 78 of male extender 76 mechanically and electrically connects to second terminal end 51 of female extender 48 at a field joint 84 disposed proximal the threaded connection between housing 46 and tubular member 47. In this embodiment, field joint 84 is made up at the well system 10, as the BHA 40 is assembled at well system 10. Also in this embodiment, an embodiment of a "wet stab" or "wet mate" multi-contact electrical connector assembly 100 is disposed in field joint 84 and is configured to electrically couple conductors 80 of male extender 76 with conductors 56 of female extender 48. While in this embodiment multi-contact electrical connector 100 is used in MWD module 42, in other embodiments multi-contact electrical connector 100 may be used with other downhole tools, such as LWD tool 44. Given that field joint 84 may be made up at well system 10, wet stab electrical connector assembly 100 may be exposed to the rig environment at the rig floor 12.

Referring to FIGS. 3-6, wet stab electrical connector assembly 100 generally includes an embodiment of a female electrical connector 110 and an embodiment of a male electrical connector 200, where female electrical connector 110 may be coupled with male electrical connector 200 to form an electrical connection therebetween. As will be described further herein, female electrical connector 110 and male electrical connector 200 of wet stab electrical connector assembly 100 may be exposed to the rig environment at rig floor 12 of well system 10 without damaging either connector 110, 200, or producing a faulty electrical connection once wet stab electrical connector assembly 100 has been assembled or made up during assembly of the BHA 40. While the embodiment shown in FIG. 2 includes electrical connector assembly 100 disposed in field joint 84, in other embodiments electrical connector assembly 100 may be used as a dry stab connector as part of shop joint 70. Moreover, while the embodiment shown in FIG. 2 includes electrical connector assembly 100 as part of well system 10, in other embodiments electrical connector assembly 100 may be used in systems other than well systems, such as in other industrial applications.

Figure 3:
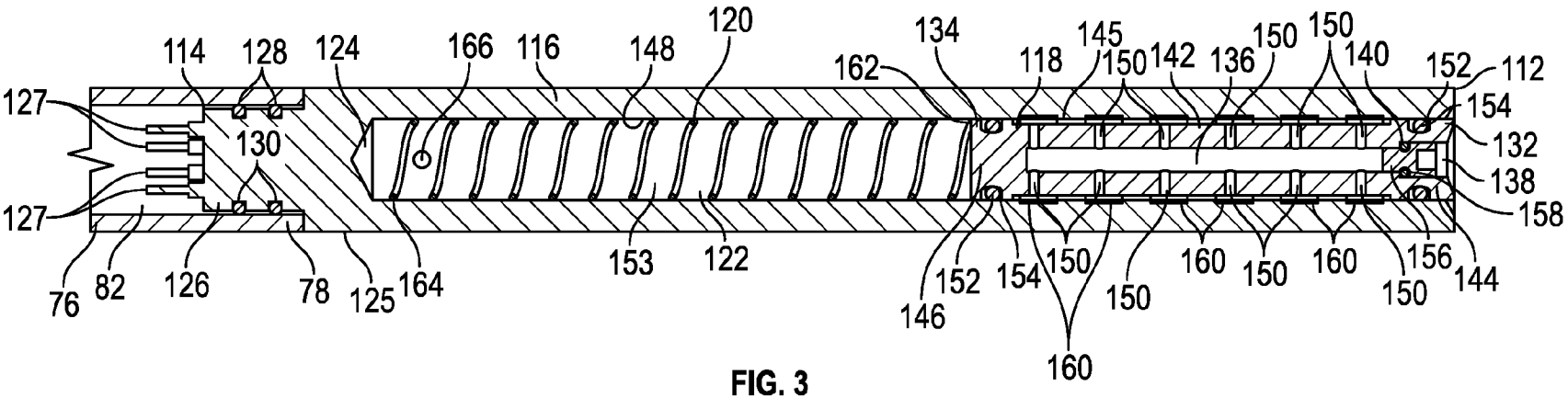
FIG. 3 illustrates an embodiment of a female connector in accordance with embodiments of an electrical connector assembly described herein.

Referring particularly to FIG. 3, female electrical connector 110 is shown in a first or disconnected position. In this embodiment, female electrical connector 110 has a first terminal end 112 and a second terminal end 114, and includes a generally cylindrical housing 116, a moveable piston 118, and a biasing member 120. A bore 122 extends longitudinally into housing 116 from first terminal end 112 and terminates at a terminal end 124 proximal second terminal end 114 of female electrical connector 110. Housing 116 further includes a generally cylindrical connector 126 at second terminal end 114 for sealing bore 122 from passage 82 of female extender 48. In some embodiments, the connector 126 is a pressure bulkhead connector such that a pressure bulkhead or pressure barrier is created between bore 122 and passage 82. In this embodiment, pressure bulkhead connector 126 includes a plurality of pins 127 that releasably connect to conductors 80 (not shown in FIG. 3) of female extender 48, and a pair of annular seals 128 disposed in annular grooves 130 that extend radially into an outer cylindrical surface of pressure bulkhead connector 126. In some embodiments, pressure bulkhead connector 126 is affixed to housing 116. In some embodiments, pressure bulkhead connector 126 is part of or integral with housing 116. In this arrangement, female electrical connector 110 may sealably and removably couple to the terminal end 51 of female extender 48. For instance, second terminal end 114 of female electrical connector 110 may be disposed within a pin end of terminal end 51 of female extender 48, with annular seals 128 of pressure bulkhead connector 126 sealing against an inner cylindrical surface of the pin end of female extender 48. In other embodiments, female electrical connector 110 may be disposed within a box end of female extender 48.

In this embodiment, moveable piston 118 is generally cylindrical and has a first terminal end 132 having an annular concave surface and a second terminal end 134 that engages biasing member 120. In the first position of female electrical connector 110 shown in FIG. 3, the first terminal end 132 of moveable piston 118 is disposed at first terminal end 112 of female electrical connector 110. In this embodiment, moveable piston 118 includes a bore 136 that extends longitudinally from first terminal end 132 and terminates proximal second terminal end 134. Moveable piston 118 also includes a counterbore 138 extending from first terminal end 132 and forming an annular shoulder 140. An annular groove extending substantially between first terminal end 132 and second terminal end 134 extends radially into the outer surface of moveable piston 118, forming a reduced diameter section 142, a first flange 144 proximal first terminal end 132, and a second flange 146 proximal second terminal end 134. A radially extending gap or annular chamber 145 is formed between the outer surface of the reduced diameter section 142 of moveable piston 118 and an inner cylindrical surface 148 of housing 116.

In this embodiment, moveable piston 118 further includes a plurality of longitudinally spaced ports 150 extending radially between a generally cylindrical outer surface of the reduced diameter section 142 of moveable piston 118 and bore 122 of housing 116. Longitudinally spaced ports 150 provide for fluid communication between bore 136 and annular chamber 145. Each flange 144 and 146, respectively, includes a radially inward extending groove 152 housing an annular seal 154. Seals 154 act to seal the longitudinal ends of annular chamber 145 by sealing against inner surface 148 of housing 116. Specifically, annular seal 154 of second flange 146 restricts or prevents fluid communication between annular chamber 145 and bore 122 of housing 116, and annular seal 154 of first flange 144 restricts or prevents fluid communication between annular chamber 145 and the surrounding environment. In this manner, annular seal 154 of second flange 146 forms a generally cylindrical sealed chamber 153 defined by annular seal 154 of second flange 146 and terminal end 124 of bore 122.

Disposed within bore 136 and counterbore 138 of moveable piston 118 is a locking cap 156. Locking cap 156 may include threads (not shown) on an outer cylindrical surface thereof for threadable engagement with threads disposed on an inner cylindrical surface of counterbore 138, thereby providing for a threadable connection between locking cap 156 and moveable piston 118. Disposed between locking cap 156 and the annular shoulder 140 formed between bore 136 and counterbore 138 is an annular seal 158 to restrict or prevent fluid communication between bore 136 and counterbore 138. Annular seal 158 of locking cap 156 and annular seal 154 of first flange 144 restrict or prevent the ingress of fluid, dust, or other contaminants in the surrounding environment into bore 122 of the housing 116 of female electrical connector 110.

In this embodiment, a plurality of electrical contacts 160 are disposed on the cylindrical inner surface 148 of housing 116, which are electrically connected with pins 127 via conductors (not shown) disposed in housing 116. In some embodiments, the electrical contacts 160 are annular electrical contacts, and in some embodiments the electrical contacts are smooth. In the embodiment shown in FIG. 3, female electrical connector 110 includes six smooth annular electrical contacts 160; however, in other embodiments, female electrical connector 110 may include a different number of smooth annular electrical contacts 160, including only a single smooth annular electrical contact 160. Smooth annular electrical contacts 160 do not extend substantially into bore 122 of housing 116, and thus, are disposed relatively flush with inner cylindrical surface 148. In the first position (shown in FIG. 3), the annular electrical contacts 160 are each disposed within the annular chamber 145 formed between moveable piston 118 and inner cylindrical surface 148 of housing 116. In an embodiment, annular chamber 145, radial ports 150, and bore 136 of moveable piston 118 are filled with a nonconductive fluid, such as UNIVIS J26, UNIVIS HVI 26, Krytox®, and the like. The nonconductive fluid disposed in annular chamber 145 may prevent or militate against the possibility of electrical shorting between adjacently disposed smooth annular electrical contacts 160 in the event that moisture is able to pass between annular seal 154 of first flange 144 and the cylindrical inner surface 148 of housing 116.

Biasing member 120 is disposed in bore 122 of housing 116 and includes a first terminal end 162 and a second terminal end 164. Particularly, biasing member 120 extends longitudinally between terminal end 124 of bore 122 and the second terminal end 134 of moveable piston 118. The first terminal end 162 of biasing member 120 couples with the second terminal end 134 of moveable piston 118 to retain moveable piston 118 within bore 120 of housing 116. Biasing member 120 also provides a biasing force against moveable piston 118 such that the first terminal end 132 of moveable piston 118 is disposed at first terminal end 112 of the female electrical connector 110. Specifically, in FIG. 3, biasing member 120 is shown in an expanded or neutral position where biasing member 120 does not exert a biasing force on moveable piston 118, thereby allowing moveable piston 118 to retain the longitudinal position in bore 122 shown in FIG. 3. Upon application of a force against the first terminal end 132 of moveable piston 118 in the direction of the second terminal end 114 of female electrical connector 110, a biasing force in the opposing direction will be applied against the second terminal end 134 of moveable piston 118 by biasing member 120. In this embodiment, biasing member 120 comprises a coil spring that is retained within bore 122 by a dowel pin 166 that extends radially from the inner cylindrical surface 148 of housing 116. While, in this embodiment, biasing member 120 comprises a coil spring, in other embodiments biasing member 120 may comprise other members configured to provide a biasing force against moveable piston 118.

Figure 4:
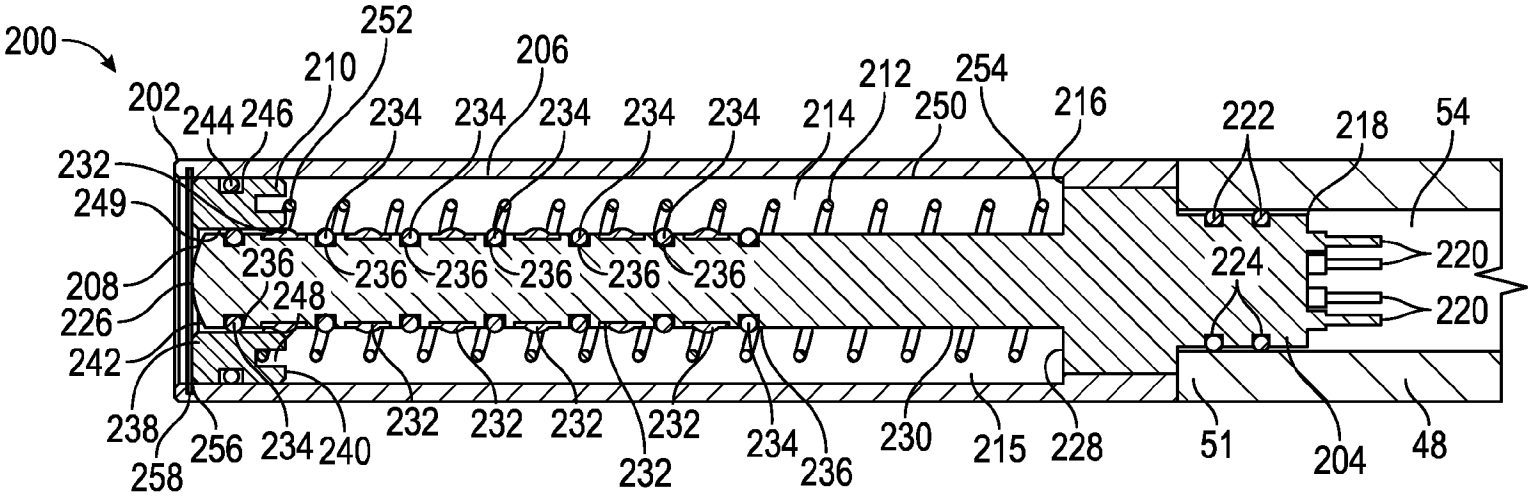
FIG. 4 illustrates an embodiment of a male connector in accordance with embodiments of an electrical connector assembly described herein.

Referring to FIG. 4, male electrical connector 200 is shown in a first or disconnected position. In this embodiment, male electrical connector 200 has a first terminal end 202 and a second terminal end 204, and includes a generally cylindrical housing 206, a conductor rod 208, an annular member or piston 210, and a biasing member 212. A bore 214 extends longitudinally into housing 206 from first terminal end 202 and terminates at a terminal end 216 proximal second terminal end 204 of male electrical connector 200. Housing 206 includes a generally cylindrical connector 218 at second terminal end 204 for sealing bore 214 from passage 54 of male extender 48. In some embodiments, the connector 218 is a pressure bulkhead connector such that a pressure bulkhead or pressure barrier is created between bore 214 and passage 54. In this embodiment, pressure bulkhead connector 218 is affixed to housing 206 and includes a plurality of pins 220 that releasably connect to electrical conductors 80 of male extender 76, and a pair of annular seals 222 disposed in annular grooves 224 extending radially into an outer cylindrical surface of pressure bulkhead 218. In some embodiments, pressure bulkhead connector 218 is part of or integral with housing 206. In this arrangement, male electrical connector 220 may sealably and removably couple to the first terminal end 78 of male extender 76. For instance, second terminal end 204 of male electrical connector 200 may be disposed within a box end of the first terminal end 78 of male extender 76, with annular seals 222 of pressure bulkhead 218 sealing against an inner cylindrical surface of the box end of male extender 76.

In this embodiment, conductor rod 208 has a convex first terminal end 226 disposed at first terminal end 202 of male electrical connector 200 and a second terminal end 228 coupled to housing 206 at terminal end 216 of bore 214. Conductor rod 208 also has a generally cylindrical outer surface 230 and a plurality of longitudinally spaced electrical contacts 232 disposed thereon. In some embodiments, the electrical contacts are annular electrical contacts, and in some embodiments the electrical contacts are spring contacts. In this embodiment, each annular spring electrical contact 232 is biased radially outward from cylindrical outer surface 230, such that annular spring electrical contacts 232 are in an extended or uncontacted position. As shown in FIG. 4, each annular spring electrical contact 232 in the extended position extends radially from outer cylindrical surface 230 of conductor rod 208 such that the annular spring electrical contacts 232 are not flush with outer cylindrical surface 230 of conductor rod 208. In the embodiment shown in FIG. 4, male electrical connector 200 includes six annular spring electrical contacts 232; however, in other embodiments, male electrical connector 200 may include a different number of annular spring electrical contacts 232, including only a single annular spring electrical contact 232. In this embodiment, each annular spring electrical contact 232 is flanked by a pair of annular seals 234, with each annular seal 234 disposed within an annular groove 236 that extends radially into the outer cylindrical surface 230 of conductor rod 208. In some embodiments, annular seals 234 may be either O-ring reals or wiper seals. The pair of annular seals 234 flanking each electrical contact 232 may serve to isolate the electrical contact from adjacent fluids or electrical contacts when electrical connector 100 is connected.

In this embodiment, annular piston 210, which is disposed about conductor rod 208, has a first terminal end 238 and a second terminal end 240 that engages biasing member 212. In the first or disconnected position of male electrical connector 200 shown in FIG. 4, the first terminal end 238 of annular piston 210 is disposed at first terminal end 202 of male electrical connector 200. Annular piston 210 includes a central bore 242 extending longitudinally between first terminal end 238 and second terminal end 240, and an annular seal 244 disposed in an annular groove 246 that extends radially into a cylindrical outer surface of annular piston 210. Annular seal 244 of annular piston 210 is configured to seal against an inner cylindrical surface 250 of housing 206.

In this embodiment, annular piston 210 also includes an annular groove 248 that extends into the second terminal end 240 to receive biasing member 212. In the first position of male electrical connector 200 shown in FIG. 4, the first annular seal 234 of conductor rod 208, which is disposed longitudinally adjacent first terminal end 226, engages a cylindrical inner surface 249 of annular piston 210. In this manner, annular seal 244 of annular piston 210 forms a generally cylindrical sealed chamber 215 longitudinally defined by annular seal 244 of annular piston 210 and terminal end 216 of bore 214. In this arrangement, annular seal 234, which seals against inner cylindrical surface 249 of annular piston 210, and annular seal 244, which seals against inner cylindrical surface 250 of housing 206, restrict or prevent the ingress of fluid, dust, or other contaminants in the surrounding environment into bore 214 of the housing 206 of male electrical connector 200. Further, as will be discussed further herein, the diameter of annular spring electrical contacts 232 in their extended position may be slightly greater than the diameter of bore 242 of annular piston 210, thereby allowing annular spring contacts 232 to engage the inner cylindrical surface 249 of annular piston 210.

Biasing member 212 is disposed in bore 214 of housing 206 and has a first terminal end 252 and a second terminal end 254. Biasing member 212 extends longitudinally between terminal end 216 of bore 214 and the second terminal end 240 of annular piston 210. The first terminal end 252 of biasing member 212 is received within annular groove 248 of annular piston 210, thereby allowing biasing member 212 to provide a biasing force against annular piston 210 such that the first terminal end 238 of annular piston 210 is disposed at first terminal end 202 of the male electrical connector 110 when male electrical connector 200 is in the first or disconnected position. For instance, upon application of a force against the first terminal end 238 of annular piston 210 in the direction of the second terminal end 204 of male electrical connector 200, a biasing force in the opposing direction will be applied against the second terminal end 240 of annular piston 210 by biasing member 212.

In this embodiment, biasing member 212 comprises a coil spring; however, in other embodiments, biasing member 212 may comprise other members configured to provide a biasing force against annular piston 210. To retain annular piston 210 within bore 214 of housing 206, an annular retaining ring or retainer 256 is disposed in an annular groove 258 that extends into inner cylindrical surface 250 of housing 206 at the first terminal end 202 of male electrical connector 200. In this arrangement, retainer 256 may engage the first terminal end 238 of annular piston 210 to prevent annular piston 210 from being displaced out of bore 214 by biasing member 210.

Figure 5:
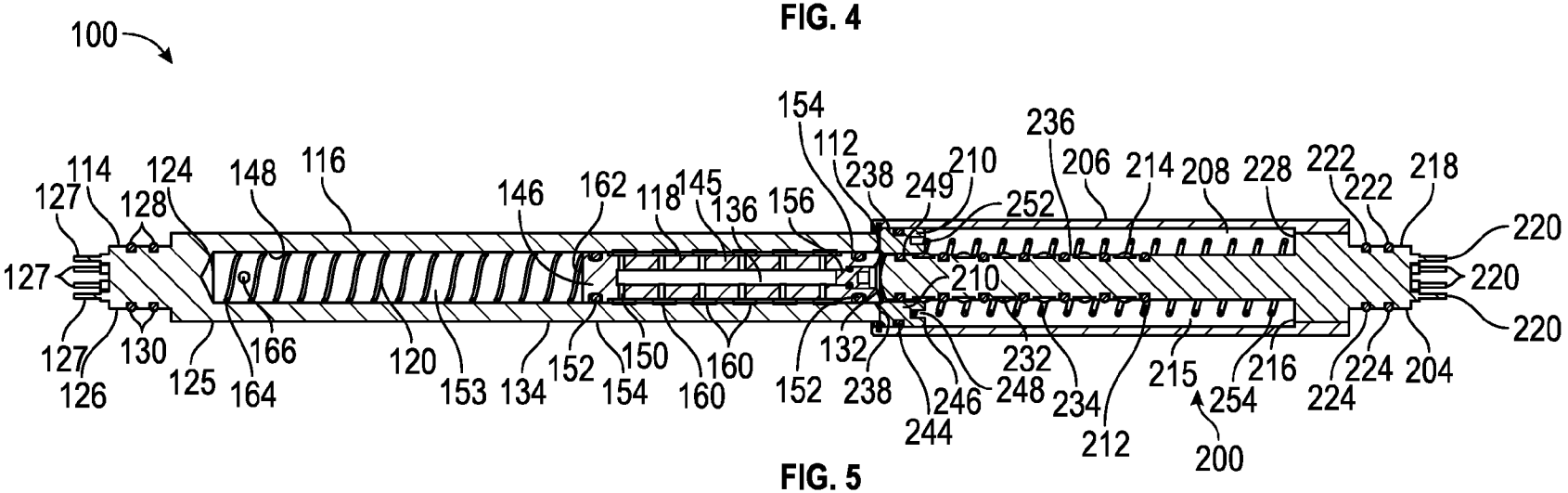
FIG. 5 illustrates the female connector of FIG. 3 and the male connector of FIG. 4 in a first position in accordance with embodiments of an electrical connector assembly described herein.

Referring to FIG. 5, female electrical connector 110 is shown axially adjacent to, and in contact with, male electrical connector 200 just prior to make up. In some embodiments, make up occurs at the rig floor 12 of well system 10. As shown in FIG. 5, the diameter of the bore 214 of housing 206 is greater than the diameter of housing 116, allowing first terminal end 112 of female electrical connector 110 to contact the first terminal end 238 of the annular piston 210 of male electrical connector 200. In this manner, an engagement or mating interface is created between the two connector portions 110, 200 of the electrical connector assembly 100, prior to electrical coupling of the two connector portions 110, 200. Further, the diameter of conductor rod 208 is less than the diameter of the bore 122 of housing 116, allowing conductor rod 208 to be inserted into bore 122, as will be discussed further herein.

Figure 6:
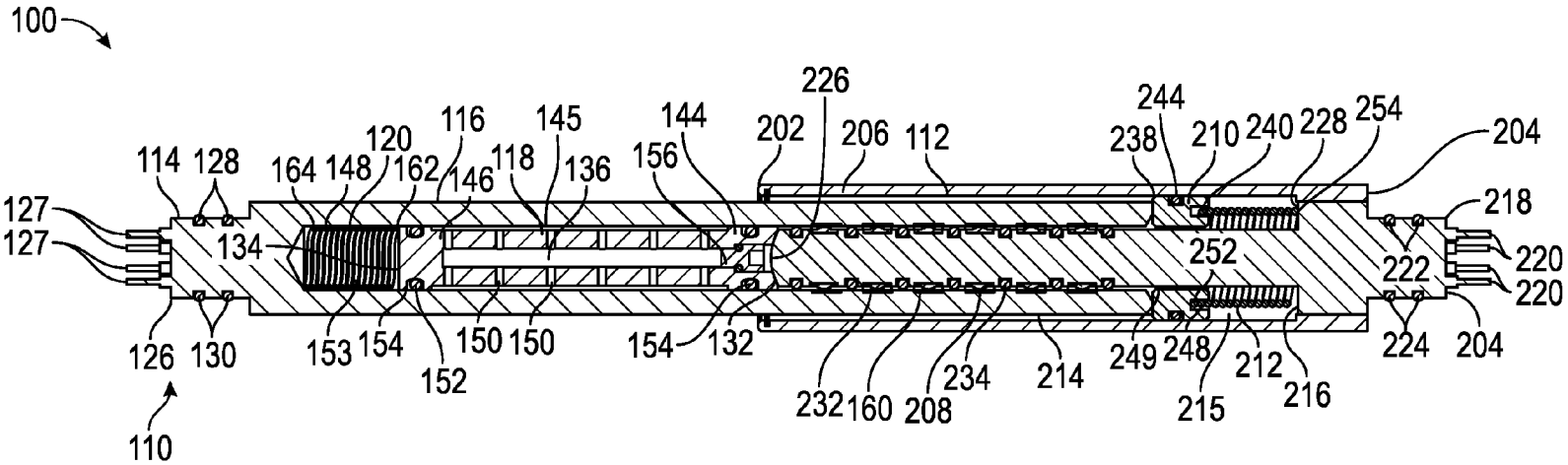
FIG. 6 illustrates the female connector of FIG. 3 and the male connector of FIG. 4 in a second position in accordance with embodiments of an electrical connector assembly described herein.

Referring to FIGS. 5 and 6, during make up of electrical connector 100 assembly, female electrical connector 110 and/or male electrical connector 200 are displaced longitudinally towards each other while female electrical connector 110 and/or male electrical connector 200 are rotated during make up of the threaded joint in which electrical connector assembly 100 is disposed, such as the threaded joint formed between the pin end 50 of housing 46 and the box end 45 of axially adjacent tubular member 47. During this process, female and male electrical connectors 110 and 200, respectively, of electrical connector assembly 100 are transitioned from the first or disconnected position shown in FIGS. 3-5 to a second or connected position shown in FIG. 6, which includes an electrical coupling. During the process of making up electrical connector assembly 100 shown in FIGS. 5 and 6, housing 116 of female electrical connector 110 is displaced into bore 214 of the housing 206 of male electrical connector 200. In particular, first terminal end 112 of housing 106 engages the first terminal end 238 of annular piston 210, thereby displacing annular piston 210 within bore 214 of housing 206 towards terminal end 216 of bore 214.

The displacement of annular piston 210 through bore 214 by housing 116 compresses biasing member 212 until biasing member 212 is in a compressed position, as shown in FIG. 6, and exposes the electrical contacts 232. The displacement of annular piston 210 also compresses or decreases the volume of sealed chamber 215 as annular seal 234 of annular piston 210 is displaced towards terminal end 215 of bore 214. In an embodiment, sealed chamber 215 within bore 214 is filled with ambient air to allow for the decrease in volume of sealed chamber 215 as male electrical connector 200 transitions between the first position shown in FIG. 5 and the second position shown in FIG. 6.

As annular piston 210 is displaced longitudinally through bore 214, inner cylindrical surface 249 of annular piston 210 physically contacts or engages each annular spring electrical contact 232 and its flanking pair of annular seals 234 of conductor rod 208. By engaging each annular spring contact 232 and its associated pair of flanking annular seals 234, the inner cylindrical surface 249 of annular piston 210 may "wipe" away or remove moisture, dust, or any other contaminants that could possibly be disposed on the surface of annular spring electrical contacts 232. Particularly, as the inner cylindrical surface 249 of annular piston 210 engages a particular annular spring electrical contact 232, the annular spring electrical contact 232 is forced to radially contract against a radially outward biasing force provided by the annular spring electrical contact 232. Thus, the use of radially flexible and biased annular spring electrical contacts 232 allows for physical engagement between annular spring electrical contacts 232 and the inner cylindrical surface 249 of annular piston 210.

Also, as electrical connector assembly 100 transitions from the first to the second position, the first terminal end 226 of conductor rod 208 physically engages the first terminal end 132 of moveable piston 118, creating a convex/concave surface interface between conductor rod 208 and movable piston 118 as previously described and shown. In other embodiments, this interface can include other mating surface shapes. In response to continued relative movement between the connector portions 110, 200, moveable piston 118 is displaced within bore 122 of housing 116 and compresses biasing member 120 via physical engagement between second terminal end 134 of moveable piston 118 and first terminal end 162 of biasing member 120. The displacement of moveable piston 118 also thereby compresses or decreases the volume of sealed chamber 153 as annular seal 154 of second flange 146 is displaced towards terminal end 124 of bore 122, and exposes the electrical contacts 160. In an embodiment, sealed chamber 153 within bore 122 may be filled with a compressible fluid, such as ambient air, to allow for the decrease in volume of sealed chamber 153 as female electrical connector 110 transitions between the first position shown in FIG. 5 and the second position shown in FIG. 6. In other embodiments, sealed chamber 153 may be adjusted relative to the ambient environment to allow for the displacement of moveable piston 118 within bore 122 of housing 116.

Further, as conductor rod 208 of male electrical connector 200 is displaced or stabbed into bore 122 of female electrical connector 110, the annular seals 236 disposed on the outer cylindrical surface 230 of conductor rod 208 may physically contact or engage the exposed smooth annular electrical contacts 160 disposed on the inner cylindrical surface 148 of bore 122. By engaging the exposed smooth annular electrical contacts 160, annular seals 236 of conductor rod 208 may wipe away or remove any moisture, dust, or any other contaminants that could possibly be disposed on the surface of smooth annular electrical contacts 160. Once female and male electrical connectors 110 and 200, respectively, have fully transitioned into the second or connected position as shown in FIG. 6, exposed annular spring electrical contacts 232 of the conductor rod 208 of male connector 200 longitudinally align with the exposed smooth annular electrical contacts 160 of the housing 116 of female contactor 110, thereby allowing each annular spring electrical contact 232 to radially engage or matingly contact a corresponding smooth annular electrical contact 160 to form an electrical connection between female electrical connector 110 and male electrical connector 200.

Figure 7:
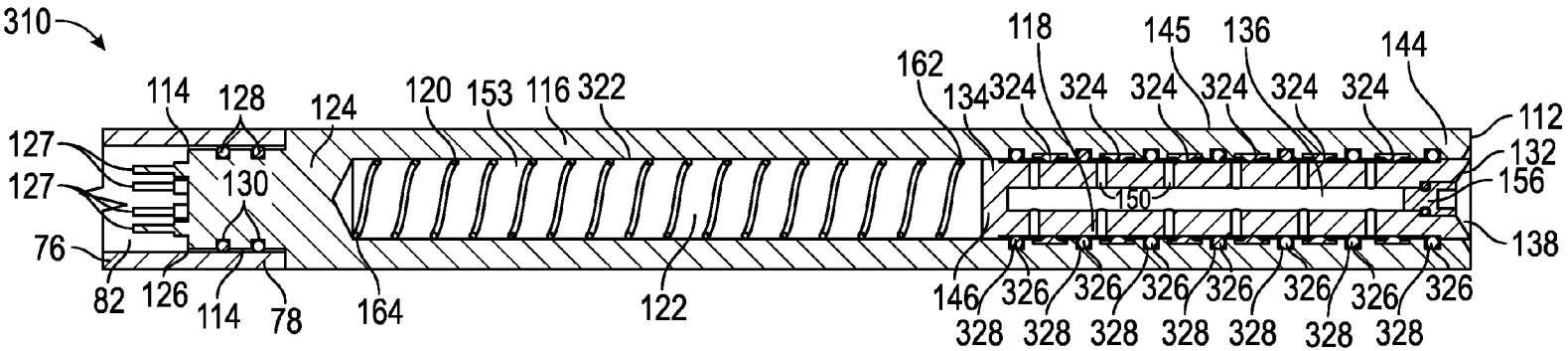
FIG. 7 illustrates another embodiment of a female connector in accordance with embodiments of an electrical connector assembly described herein.

Referring now to FIGS. 7-10, another embodiment of an electrical connector assembly 300 is shown, which generally includes another embodiment of a female electrical connector 310 and another embodiment of a male electrical connector 330. Referring particularly to FIG. 7, female electrical connector 310 includes many features in common with female electrical connector 110, and such features have been similarly labeled. In this embodiment, housing 116 includes a generally cylindrical inner surface 322 having a plurality of electrical contacts 324 disposed thereon, which electrically couple with pins 127 via conductors (not shown) disposed in housing 116. In some embodiments, the electrical contacts 324 are annular spring electrical contacts. Each annular spring electrical contact 324 is biased radially inward from cylindrical inner surface 322, such that annular spring electrical contacts 324 are in an extended or uncontacted position. As shown in FIG. 7, each annular spring electrical contact 324 in the extended position extends radially from inner cylindrical surface 322 of housing such that the annular spring electrical contacts 324 are not flush with inner cylindrical surface 322. In this embodiment, each annular spring electrical contact 324 is flanked by a pair of annular seals 326, each disposed within an annular groove 328 that extends radially into the inner cylindrical surface 322 of housing 116. In particular, a first annular seal 326 disposed proximal first end 112 of female connector 310 physically engages an outer cylindrical surface of the first flange 144 of moveable piston 118, restricting or preventing fluid communication between bore 122 and the surrounding environment. In some embodiments, annular seals 326 may be either O-ring or wiper rings.

Figure 8:
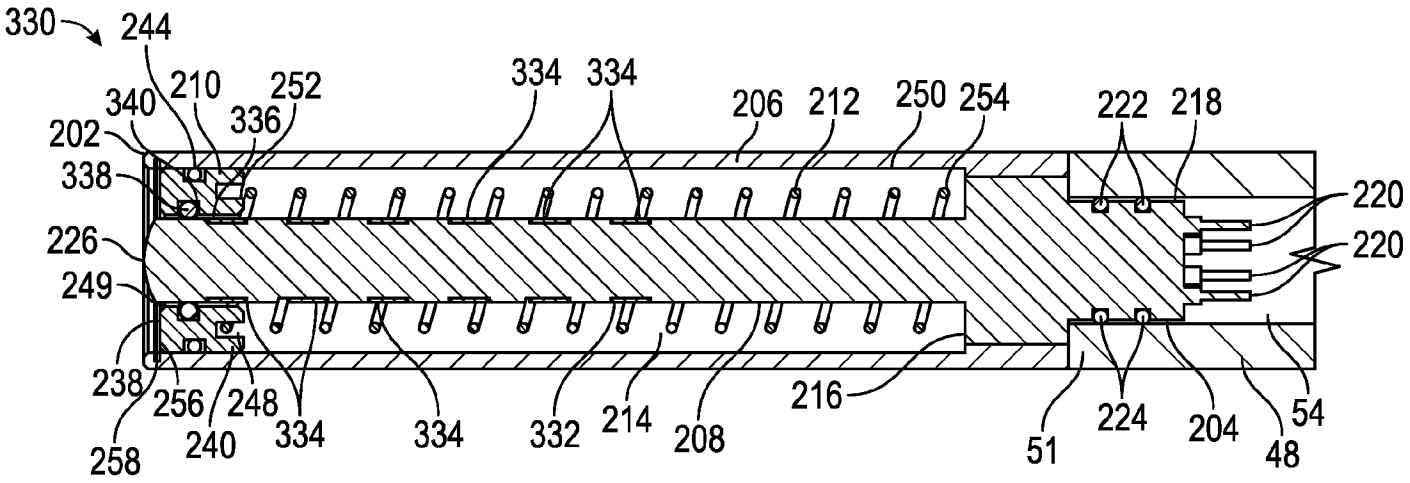
FIG. 8 illustrates another embodiment of a male connector in accordance with embodiments of an electrical connector assembly described herein.
Figure 9:
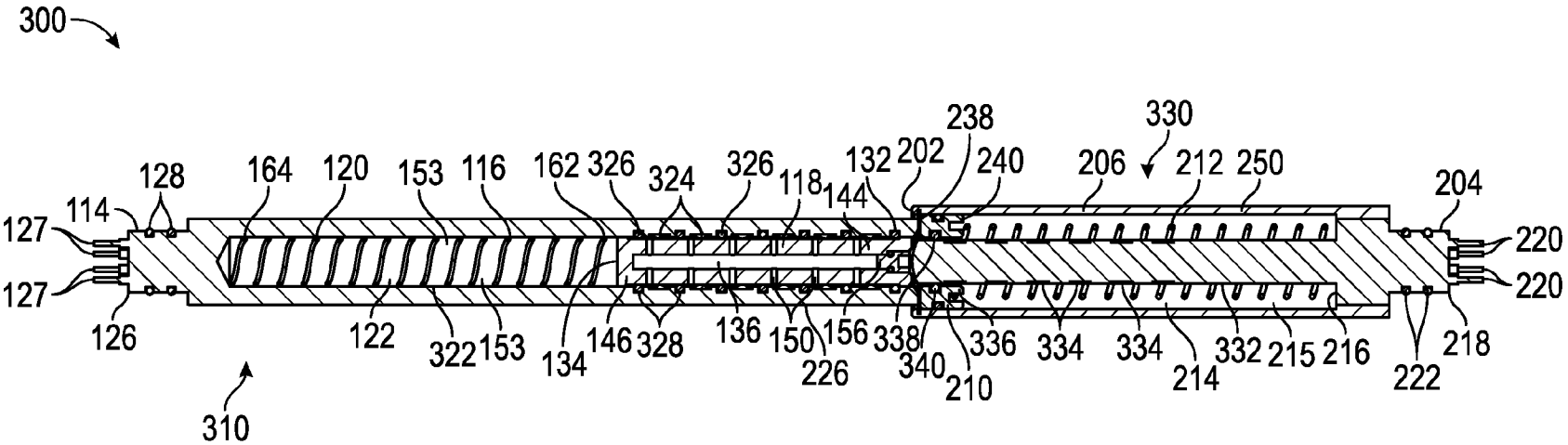
FIG. 9 illustrates the female connector of FIG. 7 and the male connector of FIG. 8 in a first position in accordance with embodiments of an electrical connector assembly described herein.
Figure 10:
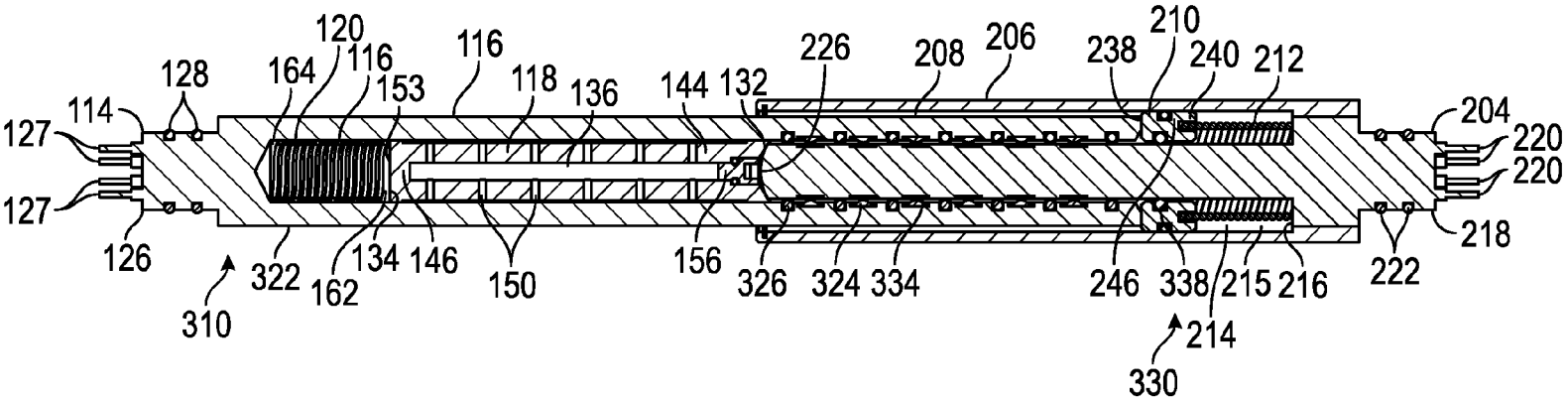
FIG. 10 illustrates the female connector of FIG. 7 and the male connector of FIG. 8 in a second position in accordance with embodiments of an electrical connector assembly described herein.

Referring to FIG. 8, male electrical connector 330 includes many features in common with male electrical connector 200, and such features have been similarly labeled. In this embodiment, conductor rod 208 has a generally cylindrical outer surface 332 including a plurality of longitudinally spaced electrical contacts 334 disposed thereon for mating engagement with annular spring electrical contacts 324 of female electrical connector 300 (shown in FIG. 10). In some embodiments, the electrical contacts 334 are smooth annular electrical contacts. Also in this embodiment, annular piston 210 has an inner generally cylindrical surface 336 including an annular seal 338 disposed in an annular groove 340 extending radially into inner cylindrical surface 336. In this arrangement, annular seal 338, which seals against inner cylindrical surface 336 of annular piston 210, and annular seal 244, which seals against the inner cylindrical surface 250 of housing 206, restrict or prevent the ingress of fluid, dust, or other contaminants in the surrounding environment into bore 214 of the housing 206 of male electrical connector 330. Referring to FIGS. 9 and 10, as female electrical connector 300 and male electrical connector 330 transition from a first, or engaged and interfacing but disconnected, position (shown in FIG. 9) to a second or connected position (shown in FIG. 10), annular seal 338 of annular piston 210 may physically engage or wipe each smooth annular contact 334 to remove moisture, dust or other debris from the surface thereof.

Figure 11:
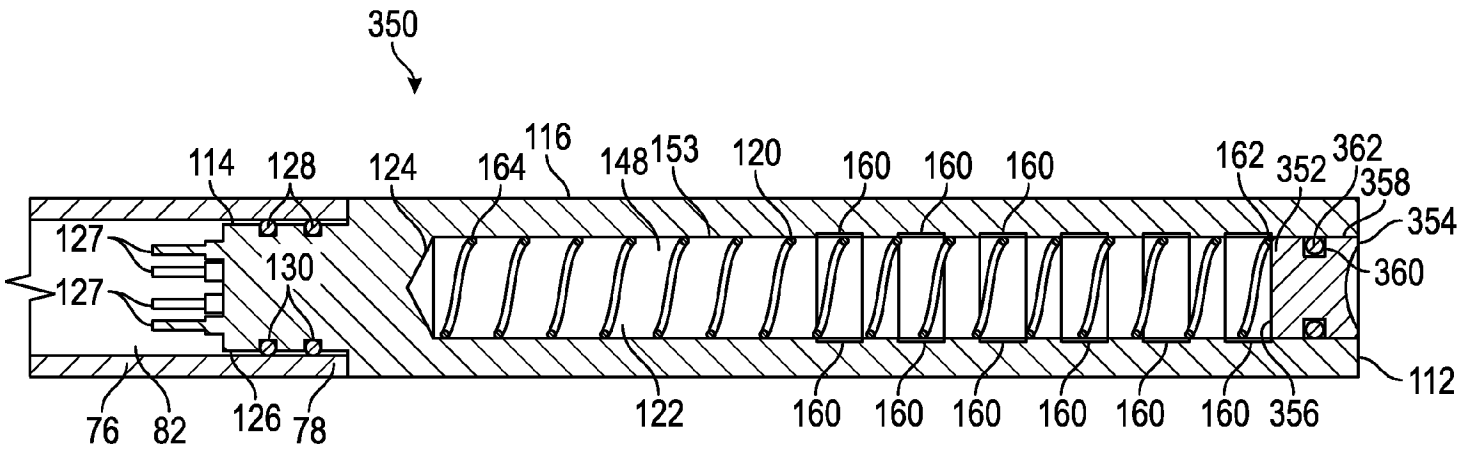
FIG. 11 illustrates another embodiment of a female connector in accordance with embodiments of an electrical connector assembly described herein.
Figure 12:
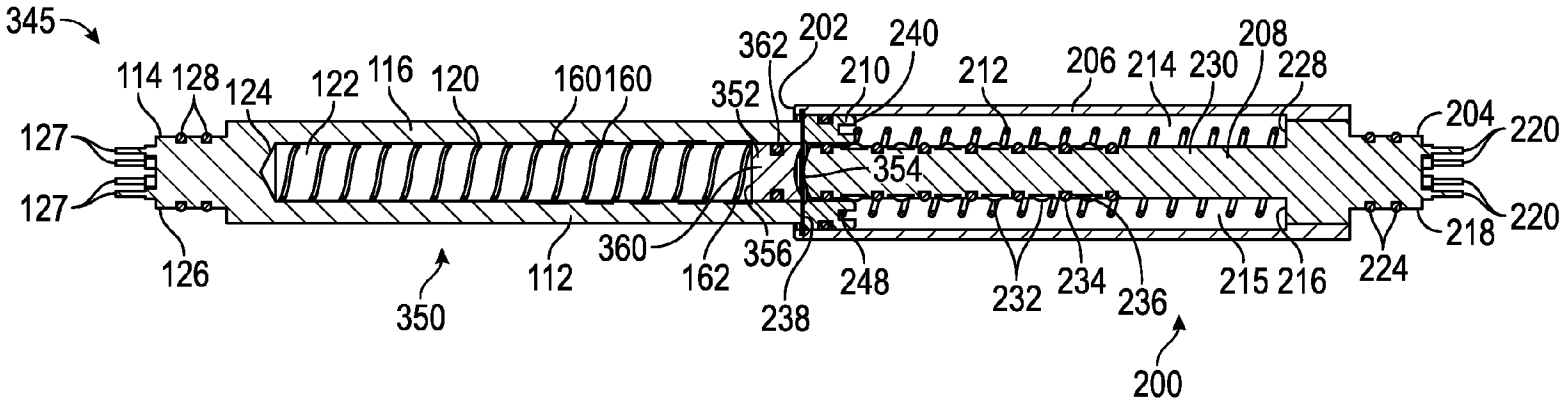
FIG. 12 illustrates the female connector of FIG. 11 and the male connector of FIG. 4 in a first position in accordance with embodiments of an electrical connector assembly described herein.
Figure 13:
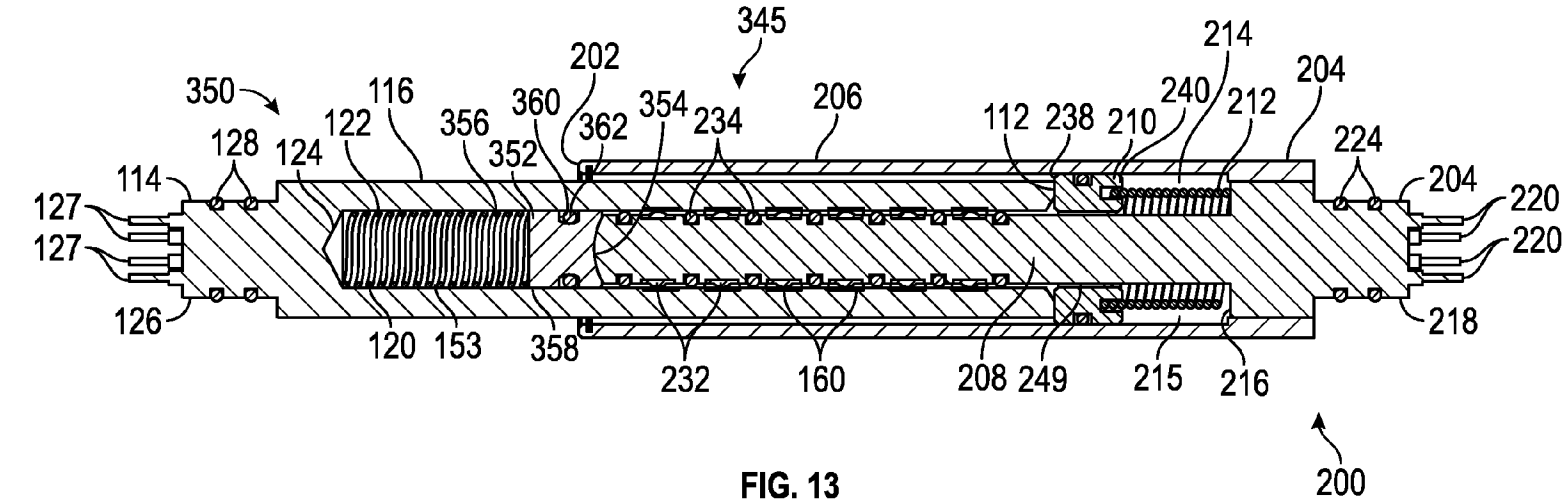
FIG. 13 illustrates the female connector of FIG. 11 and the male connector of FIG. 4 in a second position in accordance with embodiments of an electrical connector assembly described herein.

Referring now to FIGS. 11-13, another embodiment of an electrical connector assembly 345 is shown, which generally includes another embodiment of a female electrical connector 350 and male electrical connector 200. Referring particularly to FIG. 11, female electrical connector 350 includes many features in common with female electrical 110, and such features have been similarly labeled. In this embodiment, female electrical connector 350 includes a generally cylindrical piston or short piston 352 having a first terminal end 354 including an annular concave surface and a second terminal end 356 that engages biasing member 120. In the first position of female electrical connector 350 shown in FIG. 11, the first terminal end 354 of short piston 352 is disposed at first terminal end 112 of female electrical connector 350. Piston 352 includes an outer cylindrical surface 358 having a radially inward extending groove 360 housing an annular seal 362. Annular seal 362 acts to seal the longitudinal ends of annular chamber 145 by sealing against inner surface 148 of housing 116. In some embodiments, annular seals 362 may be either O-ring reals or wiper seals.

As female electrical connector 350 and male electrical connector 200 transition from a first, or engaged and interfacing but disconnected, position (shown in FIG. 12) to a second or connected position (shown in FIG. 13), the concave surface of the first terminal end 354 of piston 352 engages the convex surface of the first terminal end 226 of conductor rod 208, thereby displacing piston 352 through bore 122 of housing 116. Further, as female electrical connector 350 and male electrical connector 200 transition from the first to second positions, annular seal 362 of piston 352 may physically engage or wipe each smooth annular electrical contact 160 to remove any moisture, dust or other debris from the surface thereof. In other embodiments, the engagement between the first terminal end 354 and the first terminal end 226 includes mating shapes other than concave/convex.

Figure 14:
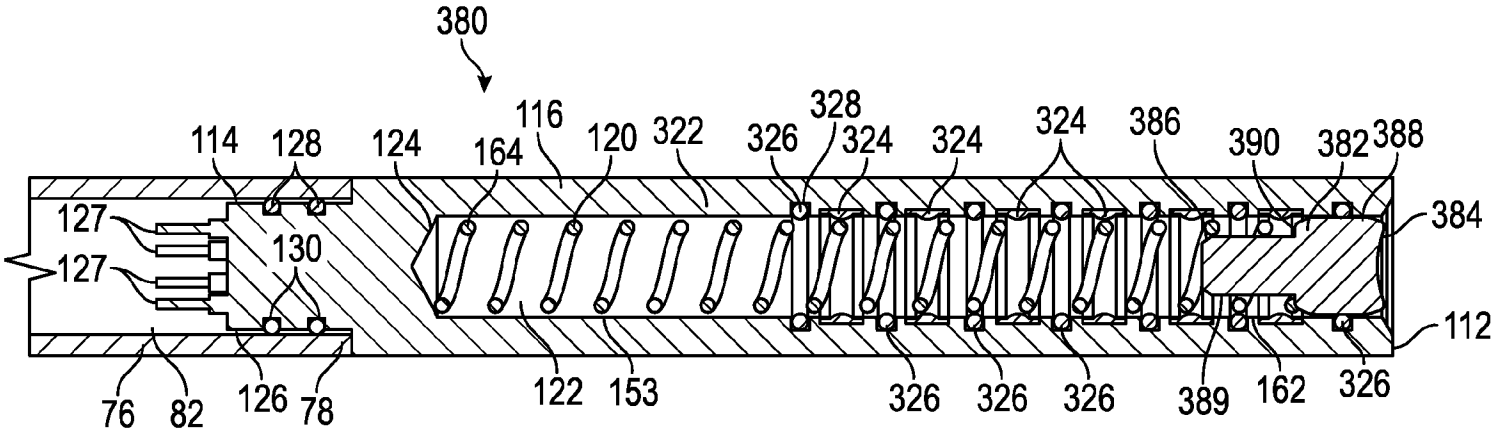
FIG. 14 illustrates another embodiment of a female connector in accordance with embodiments of an electrical connector assembly described herein.
Figure 15:
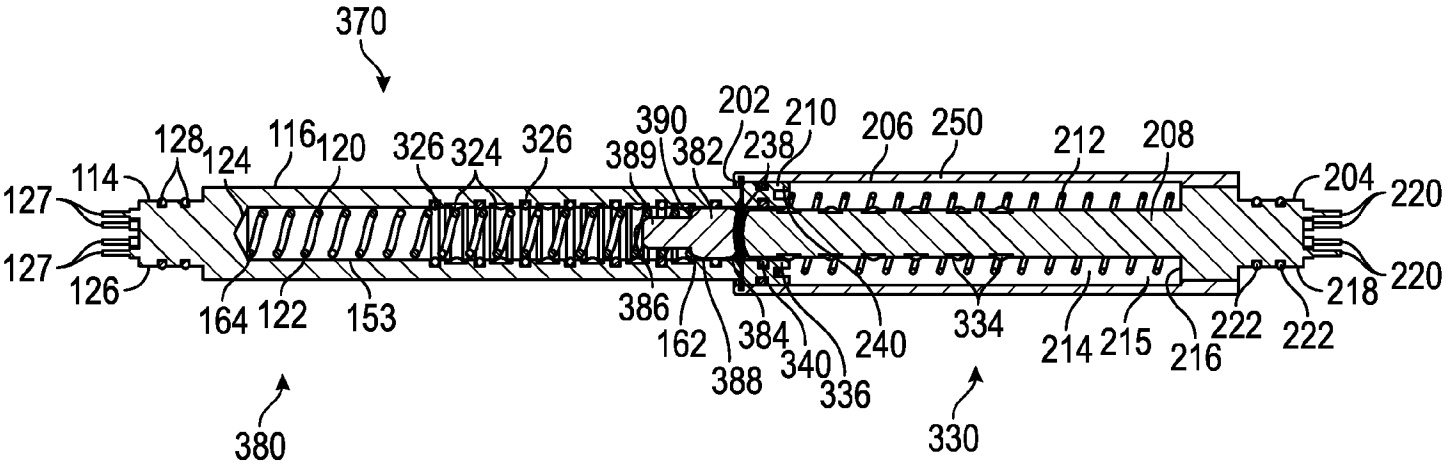
FIG. 15 illustrates the female connector of FIG. 14 and the male connector of FIG. 8 in a first position in accordance with embodiments of an electrical connector assembly described herein.
Figure 16:
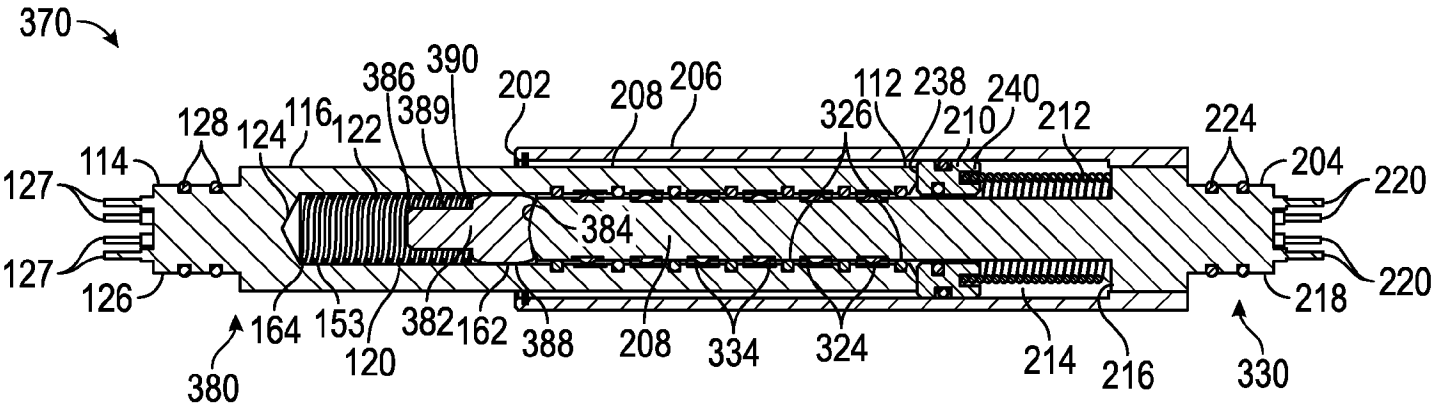
FIG. 16 illustrates the female connector of FIG. 14 and the male connector of FIG. 8 in a second position in accordance with embodiments of an electrical connector assembly described herein.

Referring to FIGS. 14-16, another embodiment of an electrical connector assembly 370 is shown, which generally includes another embodiment of a female electrical connector 380 and male electrical connector 330. Referring particularly to FIG. 14, female electrical connector 380 includes many features in common with female electrical connector 310, and such features have been similarly labeled. In this embodiment, female electrical connector 380 includes a generally cylindrical piston or short piston 382 having a first terminal end 384 including an annular concave surface and a second terminal end 386 that engages biasing member 120. In the first position of female electrical connector 380 shown in FIG. 14, the first terminal end 384 of piston 382 is disposed at first terminal end 112 of female electrical connector 380. Piston 382 includes a generally cylindrical outer surface 388 having a reduced diameter portion 389 extending from second terminal end 386, thereby forming an annular shoulder 390. The biasing member 120 extends longitudinally over the reduced diameter portion 389 of cylindrical outer surface 388 and first terminal end 162 of biasing member 120 engages annular shoulder 390.

As female electrical connector 380 and male electrical connector 330 transition from a first, or engaged and interfacing but disconnected, position (shown in FIG. 15) to a second or connected position (shown in FIG. 16), outer cylindrical surface 388 of piston 382 physically engages or wipes each spring annular contact 324 of cylindrical inner surface 322 to remove any moisture, dust or other debris from the surface thereof.

Figure 17:
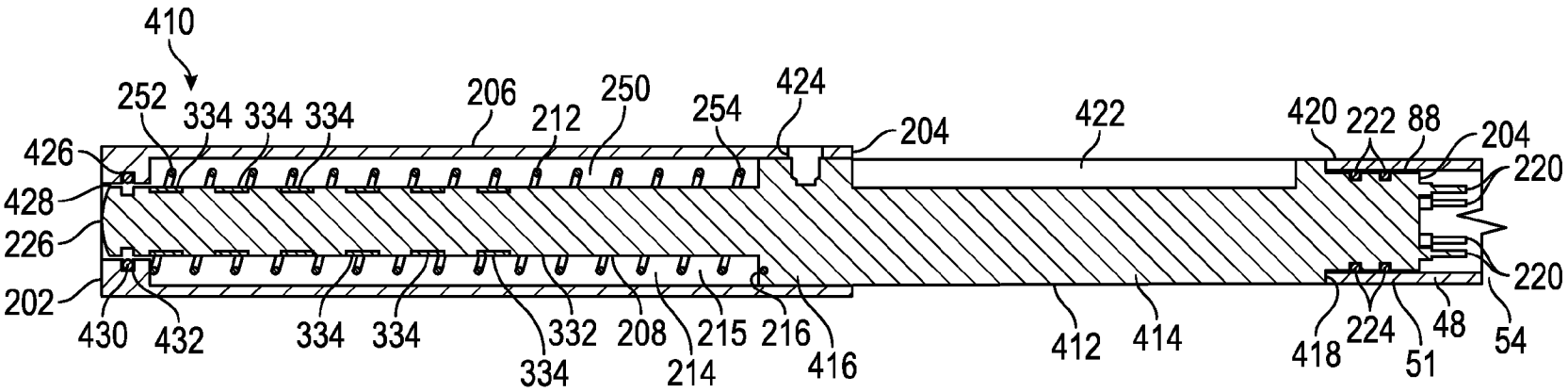
FIG. 17 illustrates another embodiment of a male connector in accordance with embodiments of an electrical connector assembly described herein.
Figure 18:
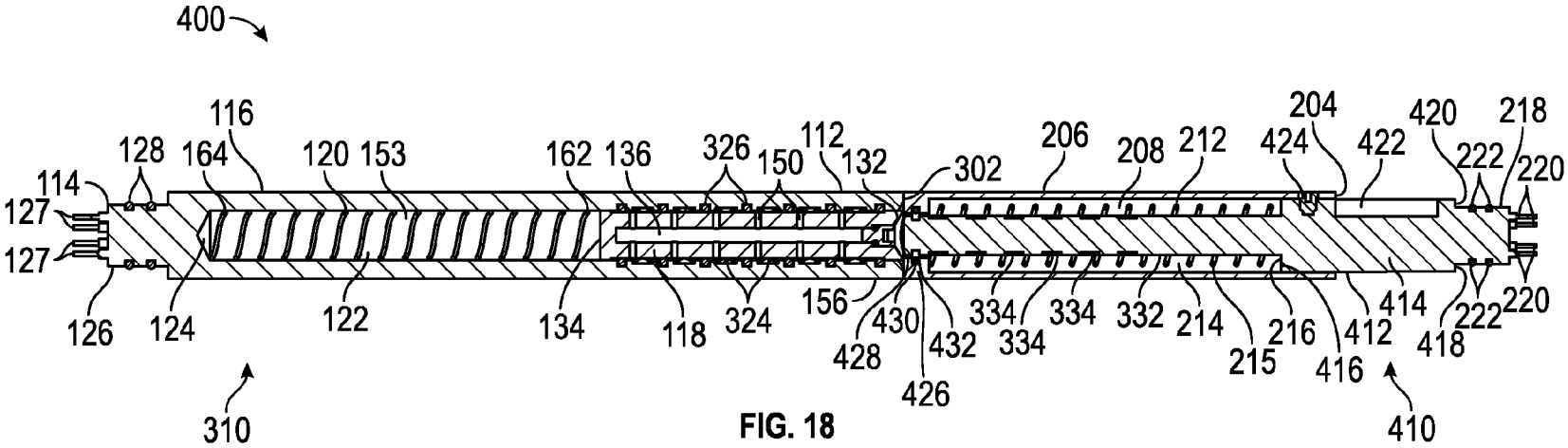
FIG. 18 illustrates the female connector of FIG. 7 and the male connector of FIG. 17 in a first position in accordance with embodiments of an electrical connector assembly described herein.
Figure 19:
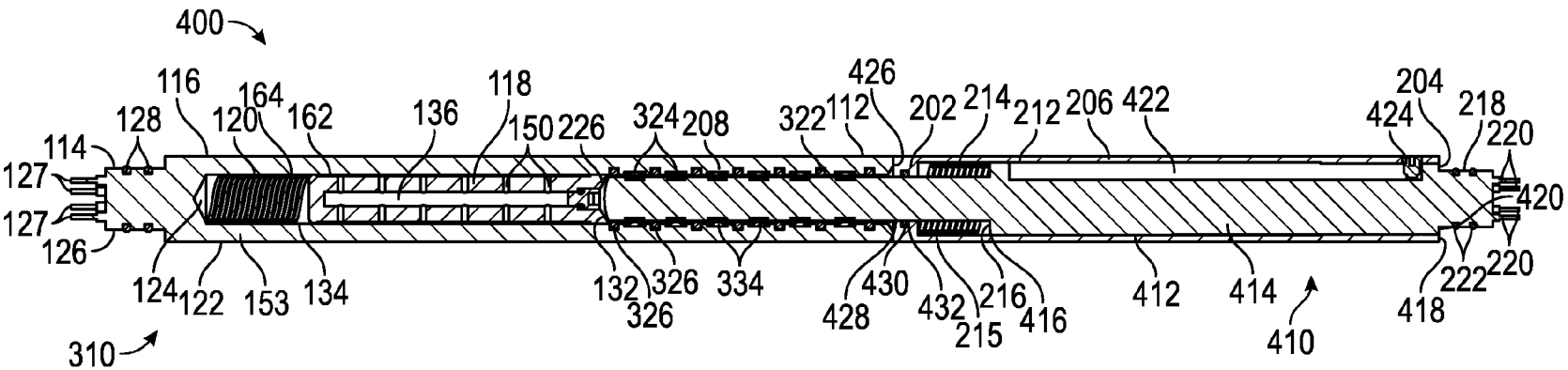
FIG. 19 illustrates the female connector of FIG. 7 and the male connector of FIG. 17 in a second position in accordance with embodiments of an electrical connector assembly described herein.

Referring to FIGS. 17-19, another embodiment of an electrical connector assembly 400 is shown, which generally includes female electrical connector 310 (FIG. 7) and another embodiment of a male electrical connector 410. Referring particularly to FIG. 14, male electrical connector 410 includes many features in common with male electrical connector 330, and such features have been similarly labeled. In this embodiment, inner cylindrical surface 250 of housing 206 is in sliding engagement with an outer generally cylindrical surface 412 of a male connector body 414 having a first terminal end 416 and a second terminal end 418. In this embodiment, second terminal end 228 of conductor rod 208 couples to first terminal end 416 of connector body 414 and a first terminal end 420 of pressure connector, or bulkhead, 218. Extending substantially between first terminal end 416 and second terminal end 418 of connector body 414 is a slot 422 extending radially into outer cylindrical surface 412. Disposed within slot 422 is a pin 424 that extends radially through housing 206 proximal second terminal end 204. In a first or unconnected position shown in FIG. 17, pin 424 is disposed in slot 422 proximal first terminal end 416 of connector body 414. In this embodiment, housing 206 also includes a radially inward extending annular member or lip 426 disposed at first terminal end 202. Annular lip 426 has an inner cylindrical surface 428 including an annular seal 430 that is disposed within an annular groove 432 extending radially into inner cylindrical surface 428. In this arrangement, annular seal 430 physically engages the outer surface 230 of conductor rod 208.

Referring to FIGS. 18 and 19, annular lip 426 of housing 206 is configured to engage the first terminal end 112 of housing 116. As female electrical connector 310 and male electrical connector 410 transition from the first or unconnected position (FIG. 18) to a second or connected position (FIG. 19) wherein an electrical connection between connectors 310 and 410 is formed, conductor rod 208 of male electrical connector 410 is displaced into bore 122 of housing 116 until annular spring electrical contacts 324 of female electrical connector 310 matingly contact or engage corresponding smooth annular electrical contacts 334 of male electrical connector 410. Also, during the transition between the first and second positions annular seal 430 physically engages or wipes each smooth annular electrical contact 334 as conductor rod 208 is displaced out of bore 214 of housing 206. Further, as male electrical connector 410 transitions from the first to the second position the pin 424 of housing 206 is displaced relative to connector body 414 from a position proximal first terminal end 416 to a position proximal second terminal end 418. In this manner, pin 424 may define the maximum amount of displacement of connector body 414 and thereby retain connector body 414 to housing 206.

Using the various embodiments of the electrical connector assembly described herein, two drill collars or other tubular members can be electrically connected via the electrical connector assembly. In some embodiments, the electrical connector assembly is a modular unit that pressure-connects between, and is removeable from, the two drill collars or other tubular members to then pass electrical signals or power therebetween. For example, the pressure connectors 126 of the various female electrical connectors described above allow the female electrical connectors to be connectable to and removeable from one of the drill collars. The pressure connectors 218 of the various male electrical connectors described above allow the male electrical connectors to be connectable to and removeable from the other, opposing drill collar. Then, when the drill collars are rotatably coupled, the male and female electrical connectors are made up to provide an electrical pathway between the two drill collars. In some embodiments, the pressure connectors 126, 218 provide a pressure barrier or bulkhead between the electrical connector assembly and the two connected drill collars. In certain embodiments, the electrical connector assemblies 100 (FIGS. 5 and 6), 300 (FIGS. 9 and 10), 345 (FIGS. 12 and 13), 370 (FIGS. 15 and 16), and 400 (FIGS. 18 and 19) are modular units that contain, protect, and maintain the selectively engageable and disengageable mating electrical contacts such that the pressure connectors 126, 218 can be used to electrically and pressure-connect two adjacent drill collars or other tubulars. In certain embodiments, the electrical connector assembly connects to extenders in the drill collars, and one or both of the electrical connectors are selectively removeable and replaceable such that the engageable electrical contact can be maintained between the pressure barriers with the two opposing drill collars.

Although only a few example embodiments have been described in detail above, those skilled in the art will readily appreciate that many modifications are possible in the example embodiments without materially departing from the electrical connector assembly. Features shown in individual embodiments referred to above may be used together in combinations other than those which have been shown and described specifically. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112 for any limitations of any of the claims herein, except for those in which the claim expressly uses the words 'means for' together with an associated function.

The embodiments described herein are examples only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A multi-contact electrical connector assembly comprising:

a first connector housing to electrically couple to a second connector housing;

a moveable piston disposed in a bore of the first connector housing, the moveable piston biased to be adjacent a first plurality of electrical contacts on a surface of the bore;

an end of the first connector housing having a first pressure connector electrically coupled to the first plurality of electrical contacts, the first pressure connector to electrically couple to a first tubular member;

a moveable annular piston disposed about a rod in a bore of the second connector housing and biased to isolate a second plurality of electrical contacts on an outer surface of the rod; and an end of the second connector housing having a second pressure connector electrically coupled to the second plurality of electrical contacts, the second pressure connector to electrically couple to a second tubular member;

wherein the first connector housing is moveable into the second connector housing and against the annular piston to overcome the annular piston biasing and expose the second plurality of contacts;

wherein the rod is moveable into the first connector housing and against the moveable piston to overcome the moveable piston biasing and move the second plurality of electrical contacts adjacent the first plurality of electrical contacts wherein the first and second pressure connectors are connectable and removeable to selectively electrically pressure-connect the electrical connector assembly between the first and second tubular members and wherein the first pressure connector connects to a first extender disposed in a first drill collar at a first pressure bulkhead and the second pressure connector connects to a second extender disposed in a second drill collar at a second pressure bulkhead.

2. The multi-contact electrical connector assembly of claim 1 further comprising an annular seal disposed on an outer surface of the moveable piston to sealingly engage the surface of the bore of the first connector housing.

3. The multi-contact electrical connector assembly of claim 2, wherein the annular seal of the moveable piston wipes each of the first plurality of electrical contacts when the first connector housing moves from a first position to a second position.

4. The multi-contact electrical connector assembly of claim 1, wherein the moveable piston comprises an internal bore filled with a nonconductive fluid in fluid communication with the first plurality of electrical contacts when the first connector housing is in a first position.

5. The multi-contact electrical connector assembly of claim 1 further comprising an annular seal disposed on an outer surface of the annular piston to sealingly engage a surface of the bore of the second connector housing.

6. The multi-contact electrical connector assembly of claim 5 further comprising an annular seal disposed on an inner surface of the annular piston to wipe the second plurality of electrical contacts when the second connector housing moves from a first position to a second position.

7. The multi-contact electrical connector assembly of claim 1 further comprising a plurality of annular seals disposed on an outer surface of the rod to isolate each of the second plurality of electrical contacts from each other.

8. The multi-contact electrical connector assembly of claim 1, wherein the rod is affixed to the second connector housing.

9. The multi-contact electrical connector assembly of claim 1, wherein the first pressure connector provides both a pressure barrier between the bore of the first connector housing and a bore of the first tubular member and a releasable electrical connection between the first plurality of electrical contacts and the first tubular member, and the second pressure connector provides both a pressure barrier between the bore of the second connector housing and a bore of the second tubular member and a releasable electrical connection between the second plurality of electrical contacts and the second tubular member.

10. A multi-contact electrical connector assembly comprising:

a first connector housing including a bore therein and comprising:

a moveable piston disposed in the bore of the first connector housing, wherein the moveable piston includes an annular seal disposed on an outer surface of the moveable piston;

a first plurality of electrical contacts disposed on a surface of the bore of the first connector housing;

a biasing member disposed in the bore of the first connector housing between a terminal end of the bore in the first connector housing and the moveable piston; and a first pressure connector on the first connector housing to releasably provide both a pressure barrier between the bore of the first connector housing and a bore of a first tubular member and an electrical connection between the first plurality of electrical contacts and the first tubular member;

wherein sealing engagement between the annular seal of the moveable piston and the first connector housing bore forms a sealed chamber between the annular seal and the terminal end of the first connector housing bore;

a second connector housing including a bore therein and comprising:

a rod in the bore of the second connector housing;

a second plurality of electrical contacts to mate with the first plurality of electrical contacts; and a second pressure connector on the second connector housing to releasably provide both a pressure barrier between the bore of the second connector housing and a bore of a second tubular member and an electrical connection between the second plurality of electrical contacts and the second tubular member wherein the first and second pressure connectors are connectable and removeable to selectively electrically pressure-connect the electrical connector assembly between the first and second tubular members and wherein the first pressure connector connects to a first extender disposed in a first drill collar at a first pressure bulkhead and the second pressure connector connects to a second extender disposed in a second drill collar at a second pressure bulkhead.

11. The multi-contact electrical connector assembly of claim 10, wherein the rod of the second connector housing is to be inserted into the bore of the first connector housing to matingly contact the first plurality of electrical contacts with the second plurality of electrical contacts.

12. The multi-contact electrical connector assembly of claim 11, wherein when the rod moves from a first position to a second position the moveable piston is displaced through the longitudinal bore to compress the sealed chamber.

13. The multi-contact electrical connector assembly of claim 10, wherein a terminal end of the moveable piston is in fluid communication with the sealed chamber of the first connector housing.

14. The multi-contact electrical connector assembly of claim 10, wherein the annular seal of the moveable piston wipes each of the first plurality of electrical contacts when the first connector housing moves from a first position to a second position.

15. The multi-contact electrical connector assembly of claim 10, further comprising an annular piston disposed about the rod and an annular seal disposed on an outer surface of the annular piston to sealingly engage the bore of the second connector housing.

16. The multi-contact electrical connector assembly of claim 10, further comprising an annular member affixed to the second connector housing to isolate the second plurality of electrical contacts.

17. A method of forming an electrical connection comprising:

removably coupling a first connector housing to a terminal end of an extender disposed in a first drill collar to provide both a pressure barrier and an electrical connection between the first connector housing and the first drill collar;

removably coupling a second connector housing to a terminal end of an extender disposed in a second drill collar to provide both a pressure barrier and an electrical connection between the second connector housing and the second drill collar;

inserting a rod of the second connector housing having a plurality of annular electrical contacts disposed thereon into a bore of the first connector housing; and matingly connecting the annular electrical contacts of the second connector housing with a plurality of annular electrical contacts disposed on a surface of the bore of the first connector housing.

18. The method of claim 17, further comprising sealing the bore of the first connector housing from the surrounding environment with a moveable piston disposed within the bore of the first connector housing.

19. The method of claim 18, further comprising wiping the annular electrical contacts of the second connector housing with an annular piston disposed about the rod of the second connector housing as the rod is inserted into the bore of the first connector housing.

20. The method of claim 19, further comprising compressing a sealed chamber in a bore of the first connector housing via displacing a moveable piston in the bore of the first connector housing that is in fluid communication with the sealed chamber.

* * * * *